US007028943B2

(12) United States Patent
Beauducel et al.

(10) Patent No.: US 7,028,943 B2
(45) Date of Patent: Apr. 18, 2006

(54) DEVICE FOR WINDING A YARN ON A HOLDER DRIVEN IN ROTATION

(75) Inventors: Florent Beauducel, Valence (FR); Jean-Baptiste Droc, Valence (FR)

(73) Assignee: Rieter Textile Machinery France, Valence Cedex (FR)

( * ) Notice: Subject to any disclaimer, the term of this patent is extended or adjusted under 35 U.S.C. 154(b) by 0 days.

(21) Appl. No.: 11/085,364

(22) Filed: Mar. 21, 2005

(65) Prior Publication Data

US 2005/0184189 A1 Aug. 25, 2005

Related U.S. Application Data

(63) Continuation of application No. PCT/FR03/02822, filed on Sep. 25, 2003.

(30) Foreign Application Priority Data

Sep. 26, 2002 (FR) ..... 02 12101

(51) Int. Cl.
*B65H 54/28* (2006.01)

(52) U.S. Cl. ..... 242/477.3; 242/480.6; 242/481.4; 474/148

(58) Field of Classification Search ..... 242/481.4, 242/486.3, 481.3, 480.5, 480.6, 477.3; 474/148
See application file for complete search history.

(56) References Cited

U.S. PATENT DOCUMENTS

| | | | | |
|---|---|---|---|---|
| 3,602,447 A | | 8/1971 | Fisher et al. | 242/43 |
| 3,633,836 A | * | 1/1972 | Haag | 242/481.4 |
| 3,716,200 A | | 2/1973 | Sartori | 242/43 |
| 3,940,078 A | * | 2/1976 | Bense et al. | 242/481.4 |
| 4,913,363 A | * | 4/1990 | Lenz | 242/477.2 |
| 6,895,736 B1 | * | 5/2005 | Badiali et al. | 57/264 |

FOREIGN PATENT DOCUMENTS

| | | | |
|---|---|---|---|
| DE | 2102615 | * | 8/1972 |
| EP | 0235557 | | 9/1987 |
| FR | 2072424 | | 9/1971 |
| JP | 49050235 | | 5/1974 |
| JP | 49061435 | | 6/1974 |

* cited by examiner

*Primary Examiner*—Kathy Matecki
*Assistant Examiner*—William E. Dondero
(74) *Attorney, Agent, or Firm*—Heslin Rothenberg Farley & Mesiti P.C.

(57) ABSTRACT

Yarn is dispensed by a yarn guide mobile in translation parallel to generatrices of a rotary holder. The device comprises a carriage receiving the yarn guide and having fittings for being coupled with a flexible transmission and driving member adapted to impart to the yarn guide a reciprocating movement, in combination with a translational guide, parallel to the generatrices of the rotary holder. The yarn guide, the translational guide and the fittings being offset at an angle on the carriage to generate an additional speed component proximate to changeover points.

8 Claims, 2 Drawing Sheets

DEVICE FOR WINDING A YARN ON A HOLDER DRIVEN IN ROTATION

CROSS-REFERENCES TO RELATED APPLICATIONS

This application is a continuation of international application PCT/FR2003/02822 filed on Sep. 25, 2003 and published, in French, as international publication number WO 2004/028943 A2 on Apr. 8, 2004, and claims priority from French patent application number 02.12101 filed on Sep. 26, 2002, the complete contents of these applications being incorporated herein by reference.

BACKGROUND INFORMATION

The invention relates to the technical sector of the winding of a textile yarn on a holder, generally in the form of a cylindrical mandrel capable of being driven in rotation. The cylindrical mandrel, or holder, can be driven in rotation either via its axis or via one of its generatrices. This winding can be used for spinning, drafting, texturing, torsion, assembling and reeling operations, etc.

It is recalled, as is perfectly well known to a person skilled in the art, that the yarn is dispensed according to a generatrix along the bobbin, in the form of inclined and parallel turns. In general, the displacement speed of the yarn guide is constant. By contrast, it is necessary for the reversal of movement at the ends of the bobbin to be carried out as quickly as possible, in order to prevent the edges of the latter from being thicker than its center.

Many technical solutions have been proposed for the production of what may be referred to as reciprocating systems at very high speed, taking into account the fact that the wound packages must have a perfect density over their entire thickness. Such wound packages may have straight flanks (cylindrical bobbin) or inclined lateral flanks (conical bobbin) or else have a conical generatrix.

According to the teaching of the patent EP 0 235 557, the reciprocating function making it possible to be sure the winding of the yarn bobbin is carried out by means of a double-helix grooved cam for driving a carriage in translational motion parallel to the axis of the bobbin. The carriage drives the yarn before it is wound onto the generatrix forming the bobbin. The reversals in direction of the carriage at the ends of the cam making the reciprocating movement possible make it necessary for the carriage to have a minimal mass in order to limit the resultant forces at the moment of the reversal in direction.

To obtain this minimal mass, the element transmitting the movement between the cam and the carriage generally consists of a shoe, part of which rubs frictionally inside the groove formed in the thickness of the cam.

Such friction is a disadvantage when the yarn tensions and the bobbin speeds are high, since it generates premature wear.

According to the teaching of the patent EP 0 453 622, the reciprocating function is implemented by means of a carriage, the yarn of which is driven by a belt or a cable secured to at least one drive pulley. The change in direction of rotation for carrying out the reciprocating movement of the carriage is executed by the reversal in the direction of the pulley.

Such a solution necessitates sophisticated electronics for executing the reversal in direction, in view of the very short time for executing such reversals and of the accuracy necessary for the positioning of these.

It is also noted that the transmission elements, such as the rotor of the motor, the belt and the pulleys, must undergo reversal in direction, so that it is necessary for their elements to have very low inertia, thus making them fragile when the reeling tensions and speeds are high.

BRIEF SUMMARY OF THE INVENTION

The set object of the invention is to overcome these disadvantages in a simple, reliable, effective and efficient way.

The problem which the invention proposes to solve is to execute a reversal in direction of the movement by simple mechanical guidance in a positive and accurate way and without friction.

To solve such a problem, a device for winding a yarn on a holder driven in rotation was designed and developed, the yarn being dispensed by means of a yarn guide displaceable in translational motion parallel to the generatrices of the holder driven in rotation. According to the invention, this device comprises a carriage receiving the yarn guide and having arrangements for coupling to a transmission and flexible drive member capable of imparting a reciprocating movement to said yarn guide, in combination with means for guidance in translational motion parallel to the generatrices of the rotary holder, the yarn guide, the guidance means and the coupling arrangements being offset angularly on the carriage in order to generate an additional speed component in the vicinity of the reversal point.

In view of the characteristics on which the invention is based, the sole reversed mass is that of the carriage driving the yarn in translational motion.

To solve the problem of generating an additional speed component in the vicinity of the reversal point, the yarn guide, the guidance means and the coupling arrangements which the carriage possesses are arranged according to the three vertices of a triangle, in particular a right-angled triangle. The means for guidance in translational motion are arranged between the yarn guide and the coupling arrangements. The guidance means are separated from the yarn guide and from the coupling arrangements at distances which are or are not equal and are determined in order to speed up the reversal times at said yarn guide.

To solve the problem of ensuring the drive of the carriage in translational motion according to a reciprocating movement, the transmission and flexible drive member consists of a notched belt (or a chain) mounted between two gearwheels, at least one of which is driven in rotation, the coupling arrangements of the carriage being secured to a part of said belt, so as to subject the reciprocating movement to the orientation of the contour of the belt.

The result of this is that winding is not carried out based on the reversal in direction of the belt, but based on the reciprocating movement executed by the orientation of the contour of this belt mounted between the gearwheels.

To solve the problem of ensuring the coupling of the carriage and of a part of the belt, the arrangements for coupling the carriage to the part of the belt consist of a connection of a pivot type. This connection has at least one shaft carried by a fork joint gripping the cross section of the belt, said shaft being positioned between two teeth of the belt, the fork joint being connected to the carriage with the capacity for articulation.

To solve the problem of varying the displacement of the carriage parallel to the generatrices of the rotary holder, the linear guide means of the carriage consist of a stud engaged in a rectilinear groove formed in the thickness of a support plate parallel to the generatrices of the rotary holder. The plate is in two parts delimiting a free space within which the carriage is displaced.

To solve the problem of varying the stroke of the yarn guide and consequently the yarn depositing stroke, the major axis of the path described by the transmission and drive member forms an angle with the linear guidance axis of the carriage, so that the total stroke of the yarn guide depends on said angle which is adjustable.

BRIEF DESCRIPTION OF THE DRAWINGS

The invention is explained in more detail below with the aid of the figures of the accompanying drawings in which.

DETAILED DESCRIPTION

Figure 1:
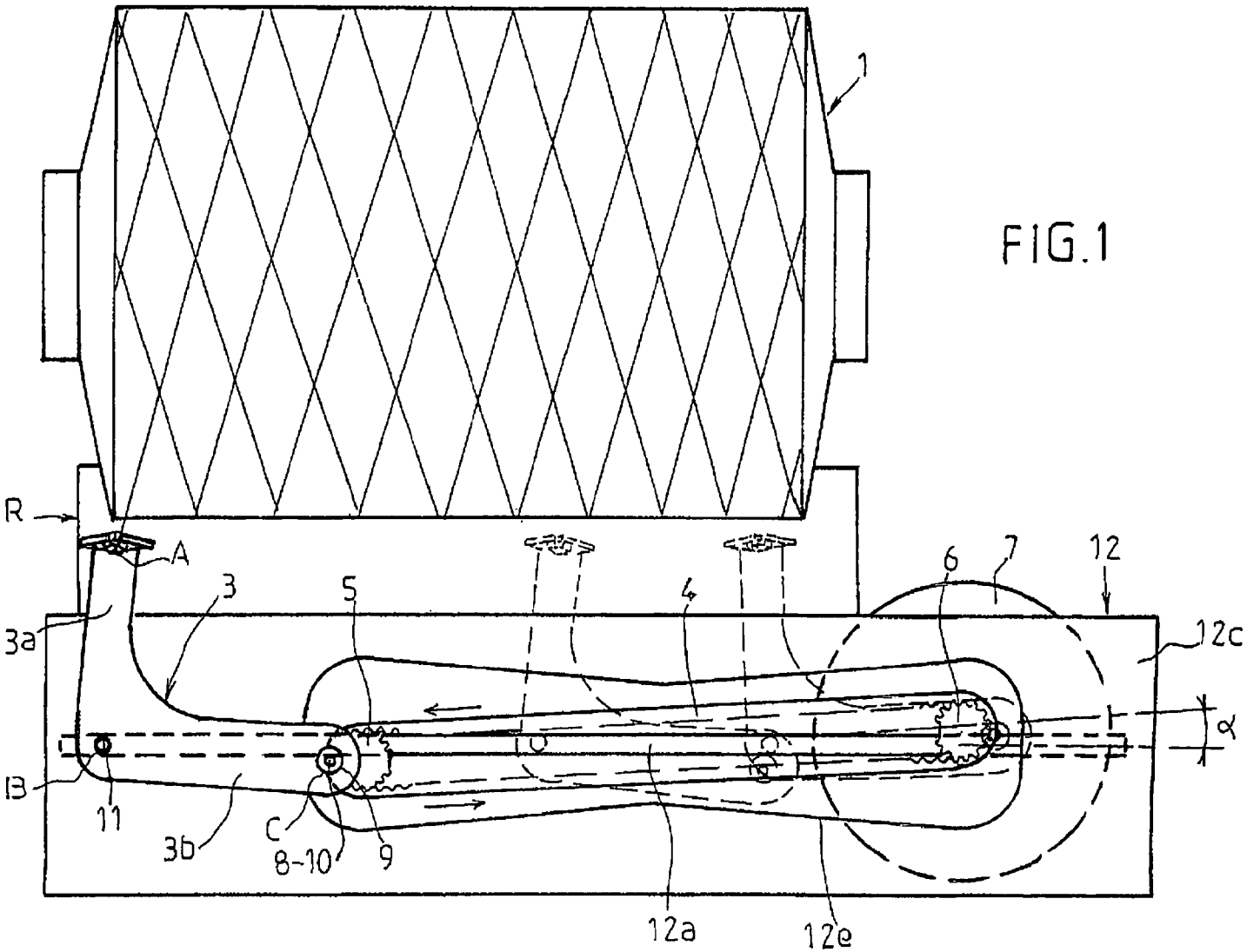
FIG. 1 is a diagrammatic plan view of the winding device according to the invention.
Figure 2:
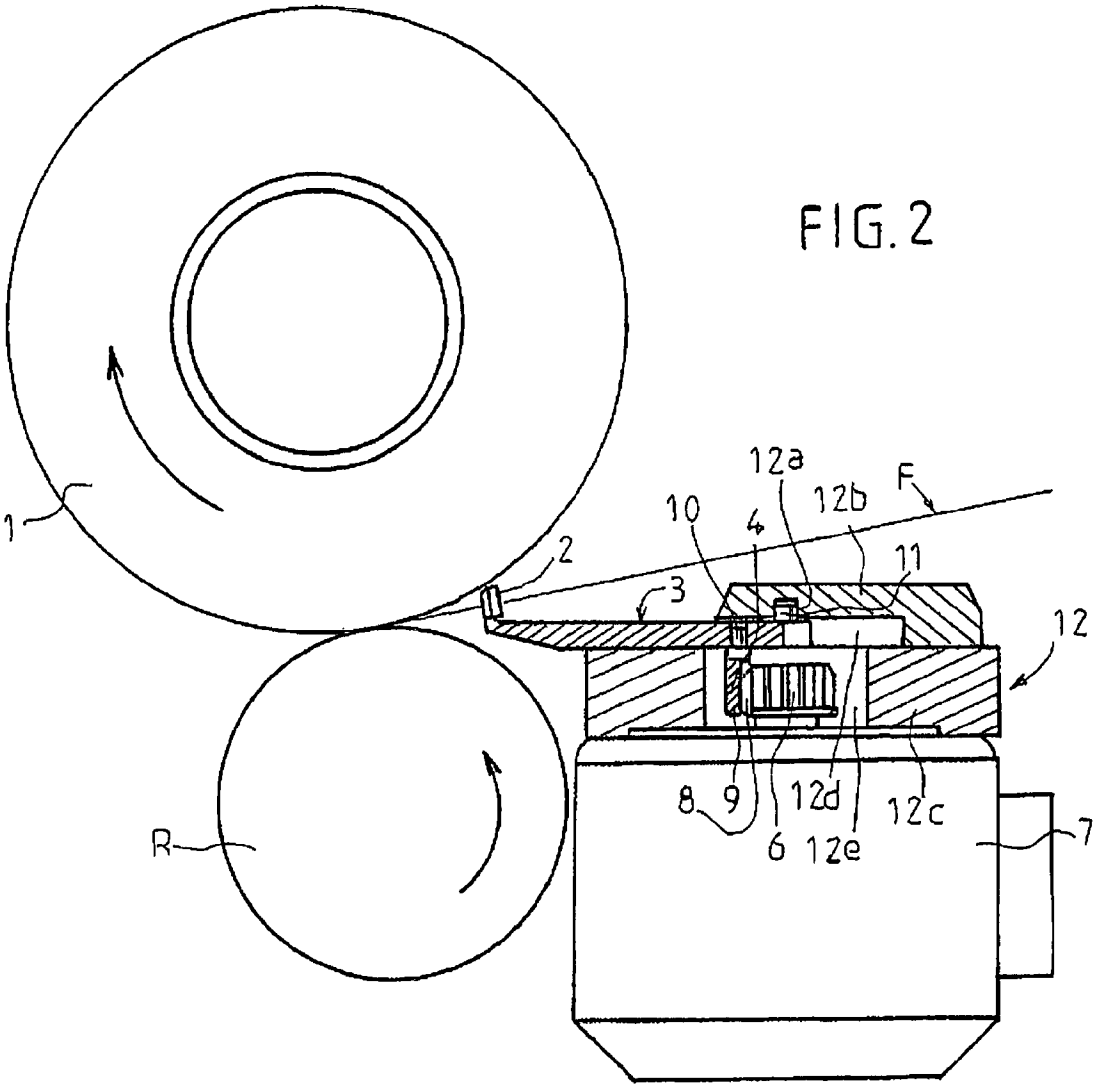
FIG. 2 is a cross-sectional view of the winding device of FIG. 1.

The figures of the drawings illustrate, for example, the winding of a yarn (F) on a bobbin (1) driven in rotation by a pick-up cylinder (R). In a known way, the yarn (F) is dispensed by means of a yarn guide (2) displaceable in translational motion parallel to the generatrices of the holding bobbin (1). The sought-after object is to subject the yarn guide (2) to a reciprocating movement composed of a zone of linear speed and of two end zones to the briefest possible turnback.

According to the invention, the winding device comprises a carriage (3) receiving the yarn guide (2). This carriage (3) has arrangements for coupling to a transmission and flexible drive member (4) capable of imparting a reciprocating movement to the yarn guide (2) in combination with the means for guidance in translational motion parallel to the generatrices of the bobbin (1). The transmission and flexible drive member advantageously consists of a notched belt (4) mounted between two gearwheels (5) and (6), at least one of which is driven in rotation.

For example, the gearwheel (6) is driven in rotation by a motor (7), while the gearwheel (5) acts as a return. The belt (4) is tensioned between the two pulleys (5) and (6).

The coupling arrangements of the carriage (3) are secured to a part of the belt (4), so as to subject the reciprocating movement to the orientation of the contour of the belt. For example, the arrangements for coupling the carriage (3) to the part of the belt (4) consist of a connection of the pivot type. This connection of a pivot type has, at least, a shaft (8) carried by a fork joint or yoke (9) gripping the cross section of the belt (4). The shaft (8) is positioned between two teeth of the notched belt (4). The fork joint (9) is connected to the carriage (3) with a capacity for articulation, for example by means of a pivot shaft (10).

It should be noted that each of the gearwheels (5) and (6) has a zone corresponding to the removal of at least one tooth, in order to allow the coupling shaft (8) to pass through. The number of teeth of the wheels (5) and (6), the belt (4) and the positioning of the connection of the pivot type (8), (9) and (10) form multiples with one another, so that, at each revolution of the belt, the coupling and drive shaft (8) falls onto an absent tooth.

The linear guidance of the carriage (3) takes place by means of a stud (11) engaged in a rectilinear groove (12*a*) formed in the thickness of a support plate (12), parallel to the generatrices of the bobbin (1). The plate (12) may be in two parts (12*b*) and (12*c*) delimiting a free space (12*d*) within which the carriage (3) is displaced. For example, the groove (12*a*) is formed in the thickness of the plate (12*b*) arranged in superposition with the plate (12*c*). The plate (12*c*) has a central slot (12*e*) of oblong general shape for the mounting and engagement of the assembly consisting of wheels (5) and (6) and of the drive belt (4).

In an important way, the yarn guide (2), the guide stud (11) and the coupling pivot (10) are offset angularly on the carriage (3) in order to generate an additional speed component in the vicinity of the reversal points. In particular, the yarn guide (2), the guide stud (11) and the coupling pivot (10) are arranged according to the three vertices of a triangle, advantageously, but not limitingly, in the form of a right-angled triangle.

In view of these arrangements, the carriage (3) is profiled in the form of an L forming two arms (3*a*) and (3*b*) offset angularly at substantially 90°. The yarn guide is arranged at the free end of the arm (3*a*), while the coupling pivot (10) and the belt (4) are arranged at the free end of the arm (3*b*). The guide stud (11) is arranged between the yarn guide (2) and the coupling pivot (10) at the connection of the two arms (3*a*) and (3*b*).

(A) designates the fastening point of the yarn guide (2) on the arm (3*a*), (B) designates the fastening point of the guide stud (11) and (C) designates the fastening point of the coupling pivot (10). If the example illustrated is considered, a right-angled triangle is formed at (B). The distances (AB) and (BC) are determined in order to optimize the reversal times of the end (A). The distance between the points (B) and (C) is greater than the radius of the gear wheels (5) and (6).

In view of these arrangements, the result is that the point (C) describes a path which follows the oblong contour of the drive belt (4) driven by the wheels (5) and (6). The point (B) is consequently subjected to a translational movement along the groove (12*a*). The point (A) has a linear path when the point (C) is located between the pulleys (broken lines, FIG. 1), while a speed component is added when the point (C) passes from one side of one of the wheels (5) or (6) to the other at each of the ends.

The two gearwheels (5) and (6) are arranged with a major axis of the path of the drive belt (4) forming an angle ($\alpha$) with the groove (12*a*) in which the stud (11) is placed. This angle ($\alpha$) makes it possible to vary the stroke of the yarn guide (2) and consequently the yam depositing stroke. Under these conditions, in order to carry out stroke variations, it is sufficient to adjust the angle ($\alpha$) by any known and suitable means.

The advantages become clearly apparent from the description, and, in particular, it is stressed and recalled that the transmission of the movement takes place without friction, the reversal in direction taking place by simple mechanical guidance and therefore positively and accurately. The sole reversed mass is that of the carriage driving the yarn in translational motion.

The invention claimed is:

1. A device for winding a yarn on a holder driven in rotation, the yarn being dispensed by a yarn guide displaceable in translational motion parallel to generatrices of the holder driven in rotation, comprising:

a carriage receiving the yarn guide and having arrangements for coupling to a transmission and flexible drive member mounted between two return elements and capable of imparting a reciprocating movement to said yarn guide, in combination with means for guidance in translational motion parallel to the generatrices of the rotary holder, the yarn guide, the guidance means and the coupling arrangements being offset angularly on the carriage according to three vertices of a triangle, the means for guidance in translational motion being arranged between the yarn guide and the coupling arrangements, and serving as a tilting axis for said carriage in order to generate an additional speed component in a vicinity of reversal points under effect of tilting of said carriage about said axis during passage of said coupling arrangements from one side of the elements to another, and the guidance means being separated from the yarn guide and from the coupling arrangements at distances which are determined so as to speed up reversal times at said yarn guide.

2. The device as claimed in claim 1, wherein the yarn guide and the coupling arrangements are positioned at ends of two arms offset angularly at substantially 90° and forming the carriage, the two arms laying substantially in a plane parallel to a plane containing said drive member.

3. The device as claimed in claim 1, wherein the transmission and flexible drive member comprises a notched belt mounted between the two return elements, said elements comprising gearwheels, at least one of which is driven in rotation, the coupling arrangements of the carriage being secured to a part of said belt, so as to subject the reciprocating movement to orientation of a contour of the belt.

4. The device as claimed in claim 3, wherein the arrangements for coupling the carriage to the part of the belt comprises a connection of a pivot type.

5. The device as claimed in claim 4, wherein the connection of the pivot type has at least one shaft carried by a fork joint gripping a cross section of the belt, said shaft being positioned between two teeth of the belt, the fork joint being connected to the carriage with a capacity for articulation.

6. The device as claimed in claim 1, wherein the guidance means comprises a stud engaged in a rectilinear groove fonned in a thickness of a support plate, parallel to the generatrices of the holder.

7. The device as claimed in claim 6, wherein the plate is in two parts delimiting a free space within which the carriage is displaced.

8. The device as claimed in claim 1, wherein a major axis of a path described by the transmission and flexible drive member forms an angle with a linear guidance axis of the carriage, so that a total stroke of the yarn guide depends on said angle which is adjustable.

* * * * *

UNITED STATES PATENT AND TRADEMARK OFFICE

CERTIFICATE OF CORRECTION

PATENT NO. : 7,028,943 B2
APPLICATION NO. : 11/085364
DATED : April 18, 2006
INVENTOR(S) : Beauducel et al.

It is certified that error appears in the above-identified patent and that said Letters Patent is hereby corrected as shown below:

Claim 6

Col. 6, line 12, delete the word "fonned" and insert the word --formed--

Signed and Sealed this

Twenty-fifth Day of July, 2006

JON W. DUDAS
*Director of the United States Patent and Trademark Office*